United States Patent [19]

China

[11] 4,345,761

[45] Aug. 24, 1982

[54] TETRAHEDRAL GAMING DIE WITH RECESSED PYRAMIDAL FACES

[75] Inventor: David B. China, Shohola, Pa.

[73] Assignee: Bermas Plastics Co., Inc., Long Island City, N.Y.

[21] Appl. No.: 280,239

[22] Filed: Jul. 6, 1981

[51] Int. Cl.[3] ..... A63F 9/04

[52] U.S. Cl. ..... 273/146; 52/DIG. 10; 434/403

[58] Field of Search ..... 273/146, 288, 294, 290, 273/58 D, 58 K, 58 R, 147; 434/403; 52/DIG. 10; 272/1 B; 40/612; 46/1 L; 116/63 P, 63 T, 63 C; D21/41, 108; D9/363, 430, 431; D25/93

[56] References Cited

U.S. PATENT DOCUMENTS

| | | | |
|---|---|---|---|
| D. 138,150 | 6/1944 | Davidson | 273/58 R UX |
| D. 191,263 | 9/1961 | Kingsbury | D25/93 X |
| D. 206,635 | 1/1967 | Walter | D25/93 X |
| 2,151,066 | 3/1939 | Anderson | 434/403 |
| 3,276,017 | 9/1966 | Mullin | 272/1 B UX |
| 3,608,906 | 9/1971 | Odier | 273/146 X |
| 3,626,604 | 12/1971 | Pierce | 52/DIG. 10 UX |
| 3,841,039 | 10/1974 | Farnsworth | 52/DIG. 10 X |

OTHER PUBLICATIONS

Mathematical Models, by Cundy and Rollett, Second Edition, ©Oxford University Press, 1961, p. 194.

Polyhedron Models, by Magnus J. Wenninger, ©Cambridge University Press, 1970.

*Primary Examiner*—Richard C. Pinkham

*Assistant Examiner*—Arnold W. Kramer

*Attorney, Agent, or Firm*—Paul W. Garbo

[57] ABSTRACT

A new gaming die is an equilateral tetrahedron with each of its four sides in the form of a recessed triangular pyramid. The resulting twelve congruent triangular facets of the novel die may carry numerals, letters or other characters depending on the game for which the die or dice are designed. A unique feature of the tetrahedral die is that it can be cheaply produced by the injection molding of a thermoplastic.

8 Claims, 5 Drawing Figures

TETRAHEDRAL GAMING DIE WITH RECESSED PYRAMIDAL FACES

BACKGROUND OF THE INVENTION

This invention relates to a gaming die which is frequently played as a set of two or more dice that is randomly tossed or rolled out on a flat surface.

The term dice is widely and commonly associated with cubes having one to six spots on each of the six sides of each cube. Such dice, also called craps, have been used for centuries going back to Biblical times.

Other forms of dice have been proposed as illustrated in U.S. Pat. Nos. 809,293; 1,223,365; 1,795,562; 3,198,523; 3,208,754 and 3,463,496. While the dice shown in these patents have various numbers of faces exceeding the six faces of conventional cubic dice, die E in FIGS. 1 and 2 of U.S. Pat. No. 3,208,754 is a tetrahedron with only four faces.

The traditional cubic dice as well as the many other proposed forms of dice have solid bodies of appreciable tridimensional mass. Such solid bodies cannot properly be produced by the injection molding of a thermoplastic because of the shrinkage and warping of the hot molded body as it cools. Hence, the mass production of these solid dice by low-cost injection molding is not feasible.

A principal object of this invention is to provide a novel die with twelve recessed facets.

Another important object is to produce the novel die by the injection molding technique.

These and other objects and advantages of the invention will be apparent from the description which follows.

SUMMARY OF THE INVENTION

In accordance with this invention, a gaming die has the shape of an equilateral tetrahedron in which each of its four sides or faces is in the same form of a recessed triangular pyramid having three congruent facets. Each of the twelve facets is marked with a numeral, letter or other character depending on the game in which the die or set of dice is to be used.

When the novel tetrahedral die or set of dice is played by tossing onto a flat surface, each die will randomly land on one of its four equilateral triangular sides. Scoring is then determined by observing the marks on the three facets which can be seen opposite the apex of the tetrahedral die that is not in contact with the flat surface.

Inasmuch as the triangular pyramidal recesses in the four die sides have their inner apexes near the center of the tetrahedral die, no portion of the die has appreciable tridimensional mass or thickness. Hence, the unique die can now be simply and cheaply produced with thermoplastic materials by the injection molding technique. Those skilled in the art of injection molding will know that a conventional split or two-part mold can be used to produce the dice of this invention. One part of the mold will have cavities, each having the contours of three sides of the desired tetrahedral die. The other or mating part of the mold will have triangular pyramidal projections contoured to fit in the mold cavities and form the fourth side of each tetrahedral die. After each injection molding, the split mold is opened and the hot dice withdrawn therefrom cool down without warping or distortion.

For a fuller understanding of the invention, its further description will refer to the appended drawings.

DESCRIPTION OF PREFERRED EMBODIMENT

Figure 1:
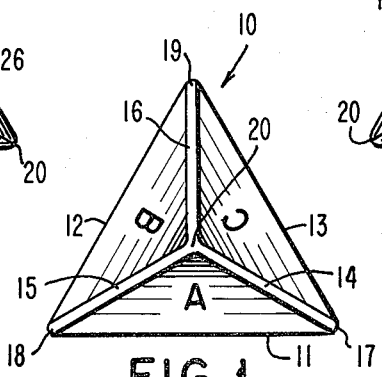
FIG. 1 is the top view of the playing die of this invention.

FIG. 1 shows die 10 when viewed from a position vertically above its apex 20. Die 10 has six edges 11, 12, 13, 14, 15, 16 which are equal in length and which form an equilateral tetrahedron or equilateral triangular pyramid with four apexes 17, 18, 19, 20.

Figure 2:
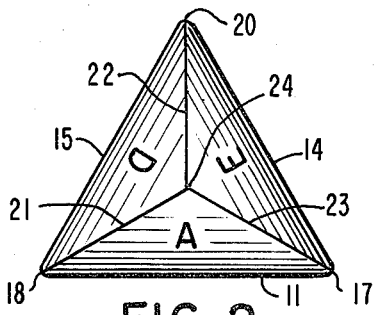
FIG. 2 is a view perpendicular to the side of the die bounded by edges 11, 14, 15.

FIG. 2 shows the triangular side of die 10 bounded by edges 11, 14, 15. This side is recessed in the form of a triangular pyramid having congruent triangular facets A, D, E. Facets A, D meet along line 21, facets D, E meet along line 22, and facets A, E meet along line 23. Lines 21, 22, 23 meet at inner apex 24 of the recessed pyramid, its outer apexes being 17, 18, 20.

Figure 3:
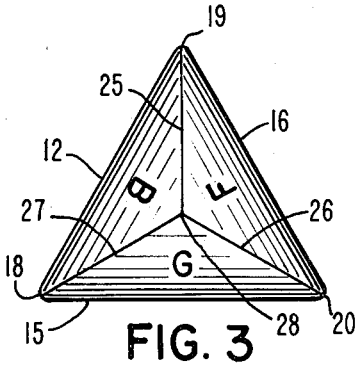
FIG. 3 is a view perpendicular to the side of the die bounded by edges 12, 15, 16.

FIG. 3 shows the triangular side of die 10 bounded by edges 12, 15, 16. This side is recessed in the form of a triangular pyramid having congruent triangular facets B, F, G. Facets B, F meet along line 25, facets F, G meet along line 26, and facets B, G meet along line 27. Lines 25, 26, 27 meet at inner apex 28 of the recessed pyramid, its outer apexes being 18, 19, 20.

Figure 4:
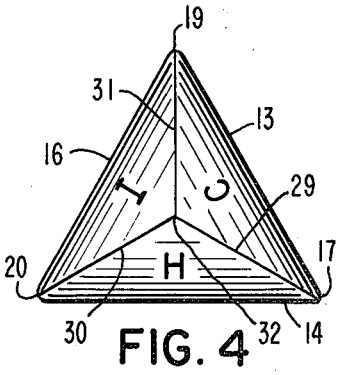
FIG. 4 is a view perpendicular to the side of the die bounded by edges 13, 14, 16.

FIG. 4 shows the triangular side of die 10 bounded by edges 13, 14, 16. This side is recessed in the form of a triangular pyramid having congruent triangular facets C, H, I. Facets C, H meet along line 29, facets H, I meet along line 30, and facets C, I meet along line 31. Lines 29, 30, 31 meet at inner apex 32 of the recessed pyramid, its outer apexes being 17, 19, 20.

Figure 5:
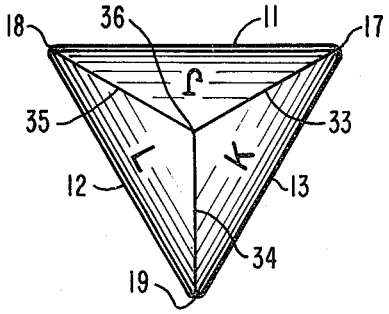
FIG. 5 is the bottom view of the die which is perpendicular to the side bounded by edges 11, 12, 13.

FIG. 5 shows the triangular side of die 10 bounded by edges 11, 12, 13. This side is recessed in the form of a triangular pyramid having congruent triangular facets J, K, L. Facets J, K meet along line 33, facets K, L meet along line 34, and facets J, L meet along line 35. Lines 33, 34, 35 meet at inner apex 36 of the recessed pyramid, its outer apexes being 17, 18, 19.

Inner apexes 24, 28, 32, 36 are equally recessed from the four sides of tetrahedral die 10 and are disposed on imaginary lines that converge at the center of die 10. In fact, if the walls between adjacent pyramidal recesses were theoretically infinitely thin, inner apexes 24, 28, 32, 36 would coincide at the center of die 10. Actually, as can be seen in FIG. 1, edge 14 is the outer end of a thin wall between facets A, C, one side of which is facet E and the other side is facet H. In other words, facets E, H are disposed back to back and form the wall which terminates in edge 14 of die 10. Preferably, particularly when die 10 is produced by the injection molding technique, facets E, H which meet in edge 14 form a slightly tapered wall that is thicker at its base than it is at edge 14. What has been said about edge 14 can be repeated for edge 15 of the wall between facets D, G, edge 16 of the wall between facets F, I, edge 11 of the wall between facets A, J, edge 12 of the wall between facets B, L, and edge 13 of the wall between facets C, K. In short, tetrahedral die 10 is completely symmetrical so that when it is repeatedly tossed onto a flat surface it will randomly come to rest on one of its four sides without favoring any one side.

Edges 11, 12, 13, 14, 15, 16 may be knife-like sharp but preferably are blunt or rounded. Likewise, apexes 17, 18, 19, 20 may be pointed but preferably are blunt or rounded.

Besides letters, numerals and other characters, different colors may be applied to the twelve triangular facets of each die. Hence, a great variety of the novel dice can be provided for use in numerous different games.

While a unique advantage of the novel die is that it can be produced by the injection molding of a thermoplastic, such as polyethylene, polypropylene or polystyrene, the die can be made of various other materials using different methods. For example, the die may be made by pouring a molten metal or alloy into appropriate cavities of a casting mold. It may be formed by milling a block of wood, stone or metal. The die may also be made of ceramic by molding clay or a like material that is then fired.

Just as the dimensions of traditional cubic dice can be varied as desired, so also can the dimensions of the triangular pyramidal dice be varied. Generally, the preferred length of each edge of the new dice is in the range of about 0.5 to 1.5 inches.

In a preferred embodiment of the invention, the dice are produced by the injection molding of polyethylene. Each edge of the dice is 1.3 inches in length and is rounded. The apexes are also rounded.

What is claimed is:

1. A novel gaming die which is in the form of an equilateral tetrahedron, characterized in that each of the four sides has the same form of a recessed triangular pyramid having three congruent facets, and the twelve congruent facets bear various markings for scoring purposes.

2. The gaming die of claim 1 wherein the inner apexes of the four recessed triangular pyramids are near the center of the tetrahedron.

3. The gaming die of claim 2 wherein the edges and apexes of the tetrahedron are rounded.

4. The gaming die of claim 3 which is produced by the injection molding of a thermoplastic.

5. The gaming die of claim 4 wherein the thermoplastic is selected from the group consisting of polyethylene, polypropylene and polystyrene.

6. The gaming die of claim 1 wherein the length of each edge of the tetrahedron is in the range of about 0.5 to 1.5 inches.

7. The gaming die of claim 1 wherein the edges and apexes of the tetrahedron are rounded.

8. The gaming die of claim 1 which is produced by the injection molding of a thermoplastic.

* * * * *